US005429266A

United States Patent [19]

D'Oliveira et al.

[11] Patent Number: 5,429,266

[45] Date of Patent: Jul. 4, 1995

[54] FOOD SERVICE TRAY

[76] Inventors: Manuel D'Oliveira; Rui Marques; Linda Pinheiro, all of 5484 Tomken Road, Unit #3, Mississauga, Ontario, Canada, L4W 2Z6

[21] Appl. No.: 257,902

[22] Filed: Jun. 13, 1994

[51] Int. Cl.[6] ..... A47G 19/03

[52] U.S. Cl. ..... 220/556; 220/23.83; 206/564; 206/565

[58] Field of Search ..... 220/556, 23.83; 206/562, 563, 564, 565, 518

[56] References Cited

U.S. PATENT DOCUMENTS

| | | | |
|---|---|---|---|
| 2,587,259 | 2/1952 | Whitman | 220/23.83 |
| 2,765,640 | 10/1956 | Hood, Jr. | 220/23.83 |
| 3,532,247 | 10/1970 | Bridges | 206/564 X |
| 3,850,333 | 11/1974 | Reichert | 220/556 |
| 4,083,453 | 4/1978 | Berger | 206/564 X |
| 4,085,845 | 4/1978 | Perfect | 229/2.5 R X |
| 4,461,396 | 7/1984 | Harper | 206/565 X |
| 5,119,967 | 6/1992 | Ercolani | 206/565 X |
| 5,152,398 | 10/1992 | Forestal et al. | 220/556 X |

*Primary Examiner*—Steven M. Pollard

[57] ABSTRACT

An food service tray including a molded plastic tray having a cup cavity, a plate cavity, an eating utensil cavity, and a napkin holder disposed thereon. The food service tray also has one thumb engaging socket for the purpose of facilitating holding the tray in a substantially horizontal disposition. In an alternate embodiment the napkin holder is a cliplike member disposed in a substantially parallel plane with respect to the facing surface of the food service tray.

1 Claim, 3 Drawing Sheets

FOOD SERVICE TRAY

BACKGROUND OF THE INVENTION

1. Field of the Invention

The present invention relates to food service devices and more particularly pertains to a food service tray which may be employed by an individual to hold food for ingestion generally in the absence of conventional tables as is frequently found in an outing scenario.

2. Description of the Prior Art

The use of substantially portable food service tables and trays is known in the prior art. More specifically, food service trays heretofore devised and utilized for individual food service are known to consist basically of familiar, expected and obvious structural configurations, notwithstanding the myriad of designs encompassed by the crowded prior art which have been developed for the fulfillment of countless objectives and requirements.

The present invention is directed to improving devices for an food service tray in a manner which is safe, secure, economical and aesthetically pleasing.

For example, U.S. Pat. No. 3,693,555 to Holtzmann discloses a foldable service table including a platform having three stops to hold various food containers firmly in place and being supported by pivotally mounted U-shaped frames which are folded for storage. The present invention comprises a platelike member held in the hand or placed flat upon another object and has no provision or requirement for firmly holding a food container, rather ridges and depressions are disposed therein to prevent food containers from sliding from the tray body. There is no requirement for leg members or support frames in the present invention.

In U.S. Pat. No. 4,972,781 to Montgomery et al. a foldable tray table is disclosed. The Montgomery et al. invention comprises a substantially rectangular table top supported by two pairs of pivotally disposed legs. The Montgomery et al. table top has one or more through holes disposed therein for the purpose of holding beverages or a book. The present invention comprises a hand held tray designed to bold a beverage container, plate, napkin, and plasticware. The present invention has no provision for and requires no legs, and has no through holes for holding beverages or other items.

In U.S. Pat. No. 3,875,873 to Howitt a table is described wherein said table has removable legs which are storable with a table top and the table has provisions for organizing food containers disposed thereon. The present invention has no legs nor are legs required for use.

In U.S. Pat. No. 3,851,599 to Bridges a table for use with disposable meal service elements is disclosed for storing and presenting for use disposable meal service elements such as plastic plates, knives, spoons, and forks, and furthermore foodstuffs are presented therein being disposed upon a rotatable food holder. A disadvantage in this prior art lies in a lack of portability and individual use. The present invention is portable and holds only individual servings for immediate consumption and has no provision or requirement for storage of quantities of foodstuff or disposable meal service elements.

In U.S. Pat. No. 3,244,125 to Mackey an auto date tray for providing meal service for one or two individuals wherein said auto date tray is compartmented for organizing and holding foodstuffs and has pivotally disposed legs of unequal length affixed to an underside therein, and furthermore, when operationally disposed, is generally placed upon a somewhat sloping substantially planar seat of an automobile for use by the occupants. The present invention is hand held and is designed to hold food service for an individual and has no pivotally deployed legs for the purpose of engaging an automobile seat.

U.S. Pat. No. 3,649,423 to Wilton et al. discloses a decorative food and beverage serving means. The disclosure teaches a food and beverage serving means such as a table, bar counter and similar items having medallion-like members disposed therein to indicate service areas. The disclosure makes no provision for portability of individual servings of foodstuffs and related utensils. Furthermore, there are no provisions for manually holding an arrangement of foodstuffs for immediate consumption. There is no teaching to enable use of the Wilton et al. invention on outings, picnics, and casual outdoor camping situations. The present invention comprises a hand held tray having disposed thereon individual service for the purpose of holding foodstuffs for immediate consumption.

In this respect, the food service tray according to the present invention substantially departs from the conventional concepts and designs of the prior art, and in so doing provides an apparatus primarily developed for the purpose of serving individual meals.

Therefore, it can be appreciated that there exists a continuing need for a new and improved food service tray which can be readily transported and used in indoor and outdoor meal serving situations. In this regard, the present invention substantially fulfills this need.

As illustrated by the background art, efforts are continuously being made in an attempt to improve food service tables and trays. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of food service trays now present in the prior art, the present invention provides an improved food service tray construction wherein the same can be utilized for individual meal service. As such, the general purpose of the present invention, which will be described subsequently in greater detail, is to provide a new and improved food service tray apparatus and method which has all the advantages of the prior art food service trays and none of the disadvantages.

The invention is defined by the appended claims with the specific embodiment shown in the attached drawings. For the purpose of summarizing the invention, the invention may be incorporated into a shallowly compartmented tray having a free peripheral form and a socket whereinto the thumb of a user may be placed to provide substantial control of the horizontal alignment of the tray to prevent tipping and spilling of the contents disposed thereupon. A vertically disposed forked member attached thereon is employed to present a napkin for use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an improved food service tray having a plurality of shallow compartments disposed thereon for the purpose of holding foodstuffs for immediate consumption.

It is therefore an additional object of the present invention to provide a new and improved food service tray which has all the advantages of the prior art food service trays and none of the disadvantages.

It is another object of the present invention to provide a new and improved food service tray which may be easily and efficiently manufactured and marketed.

It is a further object of the present invention to provide a new and improved food service tray which is of a durable and reliable construction.

An even further object of the present invention is to provide a new and improved food service tray which is susceptible of a low cost of manufacture with regard to both materials and labor, and which accordingly is then susceptible of low prices of sale to the consuming public, thereby making such food service trays economically available to the buying public.

Still yet another object of the present invention is to provide a new and improved food service tray which provides in the apparatuses and methods of the prior art some of the advantages thereof, while simultaneously overcoming some of the disadvantages normally associated therewith.

Still another object of the present invention is to provide a new and improved food service tray which may be hand held during use.

Yet another object of the present invention is to provide a new and improved food service tray of lightweight durable construction which may be easily carried in camping or picnic provisions.

Even still another object of the present invention is to provide a new and improved food service tray which may be held in one hand with substantial stability while foodstuff is consumed and otherwise delivered from the tray to the consumer using a free hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
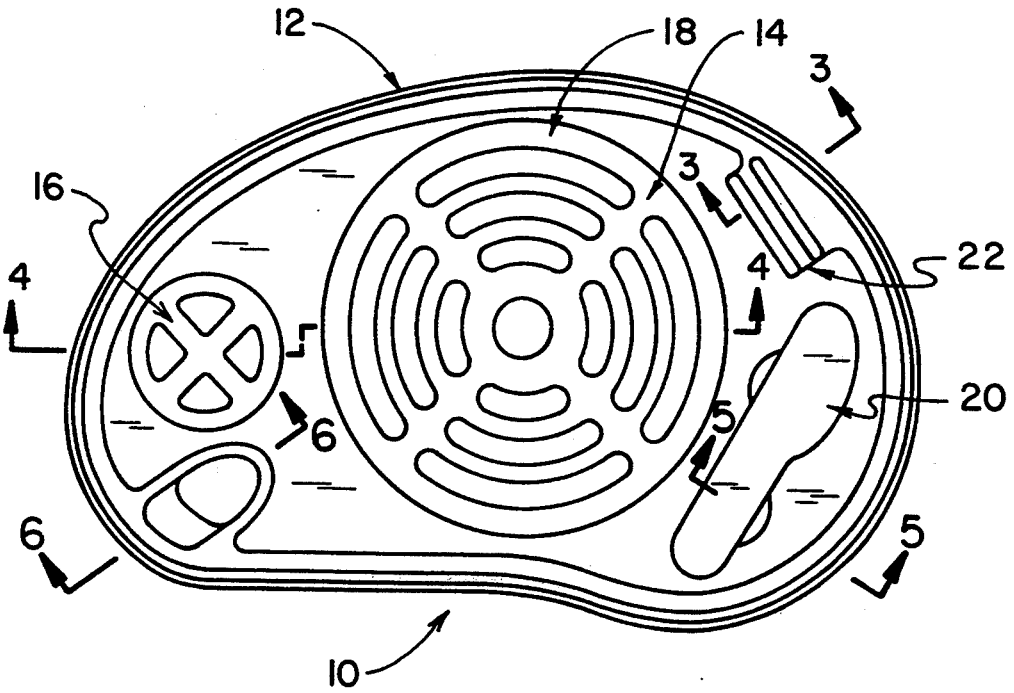
FIG. 1 is a plan view of the food service tray showing the disposition of individual compartments.

With reference now to the drawings, and in particular to FIG. 1 thereof, a new and improved food service tray embodying the principles and concepts of the present invention and generally designated by the reference numeral 10 will be described.

From an overview standpoint, the food service tray 10 is adapted for use with a plate, a cup, plastic eating utensils, paper napkins, and respectively disposed foodstuffs. See FIG. 1. The food service tray 10 comprises a substantially flattened thin walled plate having a free form perimeter 12 and a plurality of shallow cavities 14 formed in contour therein. Shallow cavities 14 are formed in a manner whereby a compatible food service container may be disposed therein for the purpose of organization, prevention of spills, prevention of slidable disengagement, and subsequent food consumption.

Figure 2:
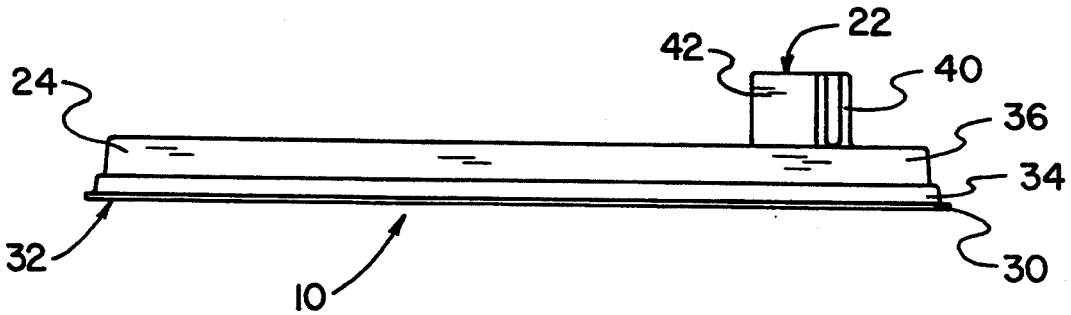
FIG. 2 is a side elevational view of the food service tray.

More specifically, it will be noted that the food service tray 10 comprises a cup compartment 16, a plate compartment 18, an eating utensil compartment 20, and a napkin holder 22 disposed as a multiplicity of shallow cavities 14 formed by contouring a relatively thin base material 24. See FIG. 2. Base material 24 is formed into perimeter 12 by vacuum forming or otherwise molding a substantially flattened sheet of polymeric material such as polyethylene into a base portion 30 which characteristically forms a surface 32 which lies in a single plane, a first size reduction portion 34 which permits disengagement of a series of stacked food service trays 10, and a second size reduction portion which engages an innermost portion of a first size reduction portion 34 of another food service tray 10 thereby permitting stacking without slidable disengagement.

Figure 3:
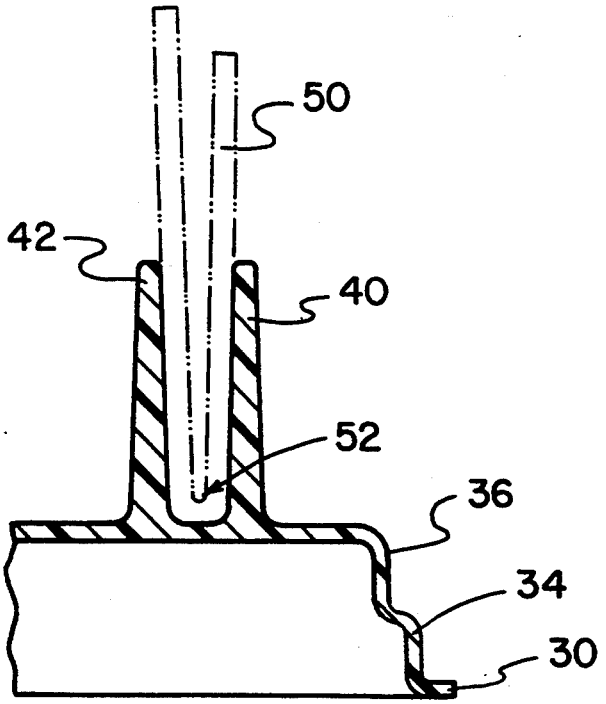
FIG. 3 is a fragmentary side sectional view of the food service tray taken substantially upon the plane indicated by the section line 3—3 of FIG. 1 and showing a napkin holding portion.

Napkin holder 22 comprises a first portion 40 and a second portion 42 wherein said first portion 40 and second portion 42 coactively hold one or more paper napkins 50 by together forming a U-shaped slot 52 whereinto a folded napkin may be insertably disposed. See FIG. 3. First portion 40 and second portion 42 may comprise substantially hollow tongues and may have resilient properties whereby napkin 50 is more tightly held. The height of first portion 40 and second portion 42 is preferably minimized to permit stacking of food service trays 10, or the napkin holder may comprise a cliplike member substantially flattenedly disposed upon a face surface 54 of the food service tray 10.

Figure 4:
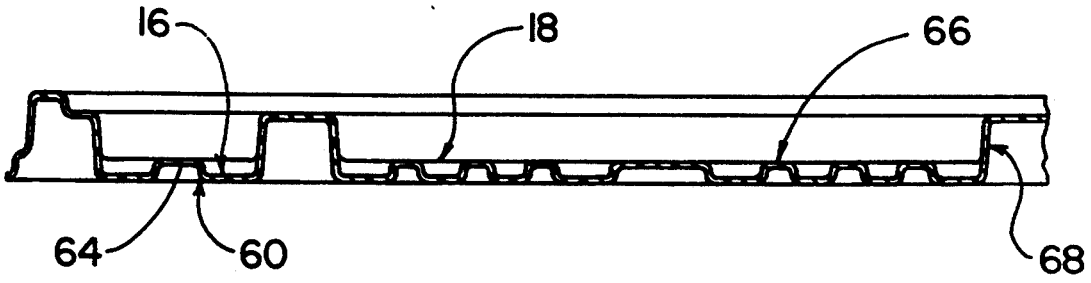
FIG. 4 is fragmentary side sectional view of the food service tray taken substantially upon the plane indicated by section line 4—4 of FIG. 1 and showing the plate and drink compartments.
Figure 5:
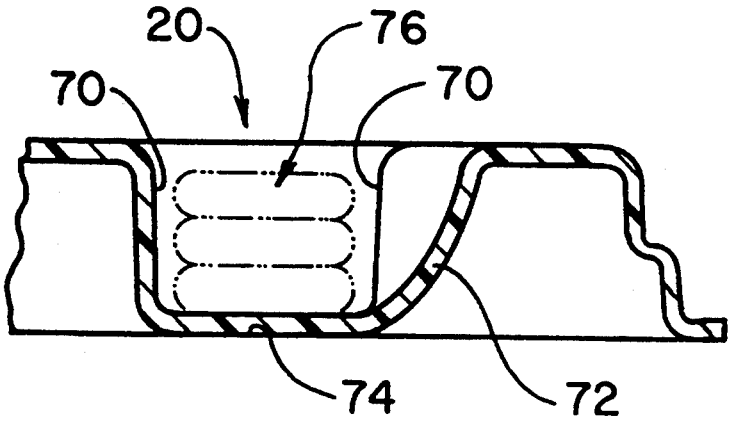
FIG. 5 is a fragmentary side sectional view of a food service tray taken substantially upon the plane indicated by the section line 5—5 of FIG. 1 and showing a finger recess.

Cup compartment 16 is formed by a molding technique and comprises a ribbed bottom portion 60 and slightly tapering sidewalls 62. See FIG. 4. Rib 64 provides additional strength thereby permitting use of thinner materials and also provides a shallow channel to capture condensation products and spills without substantially wetting the bottom of a cup engaged therein. Plate compartment 18 has a bottom portion 66 and a sidewall portion 68 wherein the bottom portion has a plurality of ribs 66 disposed therein for the purpose of added strength, and the sidewall portion 68 comprises a slightly tapering wall thereby providing for mold release and added aesthetic value. Eating utensil compartment 20 comprises a molded cavity having sidewall portions 70, notch portions 72, and a bottom portion 74. See FIG. 5.

A series of plastic eating utensils 76 including a fork, knife, and spoon are disposed within compartment 20. Sidewall portions 70 are slightly tapered for the purpose of mold release. Notch portions 72 enable the user to retrieve eating utensils disposed therein using one or more fingers. Thumb socket 80 is disposed near perimeter 12 and generally comprises a molded depression facilitating holding the food service tray 10 in a substantially horizontal disposition, and more particularly said horizontal disposition is maintained during use. In order to accommodate a user's right and left hand dexterity a second thumb socket may be disposed near perimeter 12 at a substantially mirrored location of the first thumb socket 80. Construction materials for the food service tray 10 include various colors and textures of polymerics and a nonskid rubberlike gasket material may be applied to surface 32 to preclude sliding of the food service tray 10 when used in sailboats or other vehicles. The food service tray 10 may be dishwasher safe and should enable use of a variety of cups, plates, and plastic eating utensils.

In an alternate embodiment, a planar base member is affixed over surface 30. Sand or other ballast may be included in the interstices formed when a base member is applied and nonskid feet or coatings may be applied to the exterior of the base member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed as being new and desired to be protected by Letters Patent of the United States is as follows:

1. A new and improved food service tray for providing individual food service comprising:

a molded tray form comprising of a molded construction having a free form parametric outline;

a shallow cup positioning cavity molded within said tray form;

a shallow plate positioning cavity molded within said tray form, said shallow plate positioning cavity comprising a bottom portion and a sidewall portion wherein said bottom portion has a plurality of concentric ribs disposed therein and said sidewall portion is of a substantially cylindrical form including a slight taper;

an eating utensil holding cavity molded within said tray form, said eating utensil holding cavity comprising an elongated utensil stacking portion, a plurality of oppositely disposed finger access notches disposed therein;

a napkin holding means molded within said tray form, said napkin holding means comprising a bifurcated elongated member molded in conjunction with the periphery of the tray form and furthermore said bifurcated elongated member being orthogonally disposed to a plane containing a facing surface of the food tray;

one thumb engaging socket molded within said tray form, said tray form has a downwardly extending first edge portion forming a major perimeter, a downwardly extending second edge portion of lesser perimeter than said first edge portion, and a downwardly extending third edge portion of lesser perimeter than said second edge portion.

* * * * *